United States Patent [19]

Yamaguchi et al.

[11] Patent Number: 4,669,889

[45] Date of Patent: Jun. 2, 1987

[54] APPARATUS FOR MIXING LIQUID

[75] Inventors: Shogo Yamaguchi; Enichi Yoshikawa; Eiji Tachi, all of Nagoya, Japan

[73] Assignee: Mitsubishi Jukogyo Kabushiki Kaisha, Tokyo, Japan

[21] Appl. No.: 696,109

[22] Filed: Jan. 29, 1985

[30] Foreign Application Priority Data

Jan. 30, 1984 [JP] Japan ..... 59-14659

[51] Int. Cl.[4] ..... B01F 15/02

[52] U.S. Cl. ..... 366/177; 366/182

[58] Field of Search ..... 366/160, 162, 163, 177, 366/182; 222/129.1, 136

[56] References Cited

U.S. PATENT DOCUMENTS

| | | | |
|---|---|---|---|
| 2,835,481 | 5/1958 | Cox | 366/177 X |
| 2,894,732 | 7/1959 | Taber et al. | 366/162 X |
| 3,948,490 | 4/1976 | Troope | 366/160 X |
| 4,090,262 | 5/1978 | Schneider et al. | 366/162 X |

FOREIGN PATENT DOCUMENTS

| | | | |
|---|---|---|---|
| 2619810 | 11/1977 | Fed. Rep. of Germany | 366/160 |

*Primary Examiner*—Philip R. Coe

*Attorney, Agent, or Firm*—Holman & Stern

[57] ABSTRACT

An apparatus for mixing two kinds of liquid in a predetermined ratio by using a constant volume pump. A first liquid and a second liquid are stored in tanks and maintained at a predetermined pressure, respectively. The first and second liquids are supplied to a suction side or an inlet of the constant volume pump and the second liquid supplied to the pump is measured by a measuring device to adjust it to a predetermined amount so that the first and second liquids are mixed in the predetermined ratio. The apparatus is suitable for mixture of beverages and for this purpose includes evacuating the tank for the first liquid to eliminate oxygen contained in the first liquid.

7 Claims, 2 Drawing Figures

APPARATUS FOR MIXING LIQUID

BACKGROUND OF THE INVENTION

1. Field of the Invention

The present invention relates to an apparatus for mixing a first liquid and a second liquid in a predetermined ratio for the manufacture of cooling beverages or in industry generally.

2. Description of the Prior Art

FIG. 1 shows a construction of a prior art liquid mixing apparatus for use in a manufacturing process of a cooling beverage.

Water to be processed for the manufacture of the cooling beverage is supplied through an inlet 1 to a tank 4 for use in the evacuation of oxygen. A liquid level in the tank 4 is controlled to be maintained to a predetermined level by a water control valve 2.

The tank 4 may be of a packed tower type, a wetted-wall column type, or a tray tower type. A vacuum unit 3 is coupled to the tank 4 so that oxygen contained in the water to be processed is evacuated under vacuum. The evaucated water is sent out from an outlet pipe 5 through a check valve 7 and a water pipe 8 to a water tank 10 by means of a water pump 6.

An inlet valve 9 serves to always maintain constant a level of the evacuated water supplied to the water tank 10. A syrup supply valve 12 serves to maintain constant a level of syrup for use in the manufacture of a cooling beverage in a syrup tank 13 supplied from a supply port 11.

Water in the tank 10 and syrup in the tank 13 are applied with an atmospheric pressure or are pressurized by the same pressure if necessary.

The evacuated water is supplied from the water tank 10 through a water measuring valve 14 and a water mixing valve 15 to a mixing tank 18 having a pressure therein maintained at atmospheric pressure. The amount of water flowing into the mixing tank 18 is substantially propotional to an opening of the water measuring valve 14 since the pressure applied to the water tank 10 is maintained constant and a difference between a level of the water tank 10 and a level of the mixing tank 18 is always maintained approximately constant.

Syrup is supplied from the syrup tank 13 through a syrup measuring valve 16 and a syrup mixing valve 17 to the mixing tank 18. The amount of syrup flowing into the mixing tank 18 is substantially propotional to an opening of the syrup measuring valve 16 in the same manner as that of water since the pressure applied to the syrup tank 13 is maintained constant and a difference between a level of the syrup tank 13 and a level of the mixing tank 18 is always maintained approximately constant.

The mixed liquid in the tank 18 is sent out with pressure by a mixing pump 19 through a control valve 20 to a next process. The control valve 20 is constructed to automatically control the level of the mixing tank 18 to a constant level.

The above liquid mixing apparatus has the following problems:

(1) Since the evacuation tank 4 is independent, the evacuation tank and its space are necessary.

(2) The pump 6 for the evacuated water and the check valve 7, the pipe 8 and the inlet valve 9 for sending out water are necessary.

(3) It is required to control the liquid levels in four tanks, viz., the evaucation tank 4, the water tank 10, the syrup tank 13 and the mixing tank 18.

(4) Since the mixing pump 19 is provided with the control valve 20 for maintaining constant the liquid level in the mixing tank 18, the mixing pump 19 is required to have a relatively large capacity.

BRIEF SUMMARY OF THE INVENTION

The present invention was made in view of the above problems and an object of the present invetion is to provide a liquid mixing apparatus having less parts requiring control or adjustment and which can be economically manufactured because of being small and simple in structure compared with prior art apparatus;

A further object is to provide a liquid mixing apparatus capable of evacuating oxygen contained within a first liquid in a first tank maintained at a predetermined vacuum while maintaining a level of the first liquid at a predetermined level, directing the evacuated liquid to a suction side of a constant volume tank and maintaining constant a pressure at the suction side of the pump, pouring a predetermined amount of second liquid from a second tank adjusted to a predetermined pressure through measuring means into the first liquid at the suction side of the pump, and mixing the first liquid and the second liquid in a predetermined mixture ratio depending on a constant volume characteristic of the constant volume pump.

In the present invention, the first liquid evacuated in the first tank is directed to the suction side of the constant volume pump and the second liquid is poured or sucked utilizing a negative pressure of the suction side of the pump to be mixed with the first liquid at the suction side of the pump, the mixed liquid being sent with pressure to a next process by the constant volume pump. Accordingly, an evacuation tank and a mixing tank are not necessary. Further, the flow rate of the mixed liquid is adjusted by the constant volume pump and the second liquid is sucked through the measuring means so that the flow rate of the first liquid is automatically determined and the first liquid and the second liquid can be mixed in a predetermined ratio. Thus, it is not required to control the flow rate of the first liquid. According to the present invention, portions to be controlled and adjusted are greatly reduced and the structure can be made small and simple as compared with prior art apparatus.

It is another object of the present invention to provide a liquid mixing apparatus characterized by the provision of a first tank, a vacuum unit for maintaining the first tank to a predetermined vacuum, a first liquid supply unit for supplying a predetermined first liquid to the first tank through a liquid level controller, a constant volume pump for sending out a mixed liquid and which is connected to the first tank through a suction pipe, a second tank adjusted to a predetermined pressure, a second liquid supply unit for supplying a predetermined amount of second liquid to the second tank through a liquid level controller, and a second liquid mixing unit for mixing the second liquid from the second tank through a measuring means and a nozzle to the suction side of the constant volume pump. With such a construction, the above method in which the first liquid is evacuated in the first tank and the evacuated first liquid and the second liquid are mixed in a predetermined ratio at the suction side of the constant volume pump is used in a preferable and economical liquid mixing apparatus.

In the present invention, the first and second liquid may be any kinds of liquid without limitation to water and syrup.

BRIEF DESCRIPTION OF THE DRAWINGS

The invention will now be described in detail with reference to the accompanying drawings wherein.

DETAILED DESCRIPTION

Figure 2:
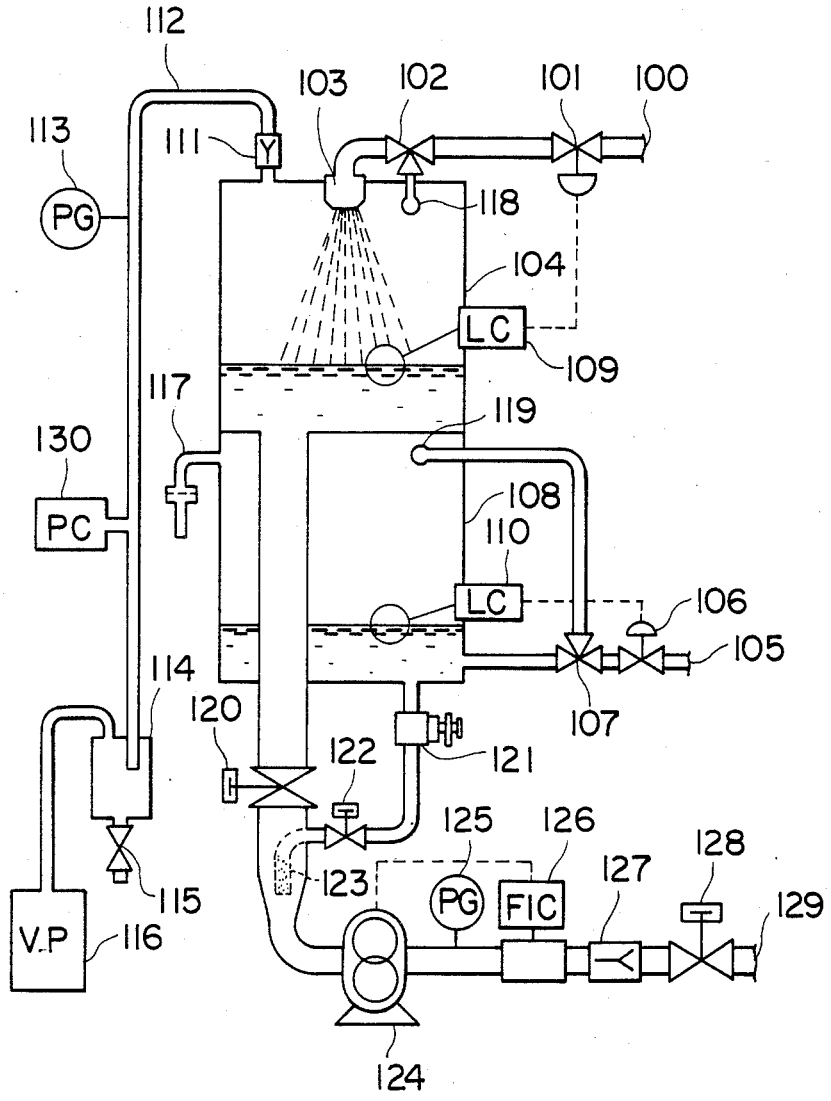
FIG. 2 is a schematic diagram showing an embodiment of a mixing apparatus according to the present invention.

FIG. 2 shows an embodiment of a liquid mixing apparatus according to the present invention, in which numeral 100 denotes a supply port for water to be processed which is provided with a liquid level control valve 101. A change-over valve 102 is used to switch the water flow either to a supply nozzle 103 to be processed, or to a washing spray 118. Numeral 104 denotes a water tank and numeral 109 denotes a liquid level controller. Water supplied from the port 100 is controlled by the liquid level controller 109 and the control valve 101 in response to the liquid level in the tank 104 to maintain the liquid level in the tank 104 constant.

The change-over valve 102 is used to supply the water to a washing spray 118 when the inside portion of the water tank 104 is washed.

A vacuum gauge 113, a vacuum controller 130, a waterdrop separator 114, a drain valve 115 and a vacuum unit 116 are attached to a vacuum pipe 112 connected to the tank 104 through a check valve 111.

The water tank 104 is evacuated by the vacuum unit 116. The check valve 111 is to prevent the water from flowing reversely. The vacuum gauge 113 is used for monitoring.

The vacuum controller 130 is to adjust the vacuum in the water tank 104 to be constant. The waterdrop separator 114 is to prevent waterdrops from entering into the vacuum unit. The drain valve 115 is to drain water collected in a bottom.

Numeral 105 denotes a syrup supply port. A liquid level control valve 106 and a change-over valve 107 are disposed on a way of a flow way from the syrup supply port 105. An amount of syrup supplied from the syrup supply port 105 is controlled by a liquid level controller 110 and the liquid level control valve 106 is accordance with the liquid level in the syrup tank 108 and the liquid level in the tank 108 is maintained constant. The change-over valve 107 switches a flow way of a washing liquid to a washing spray 119 when the syrup tank is washed. A pipe 117 is to connect the syrup tank 108 to the atmosphere or can be connected to a pressurized gas source if desired so that the syrup tank 108 is maintained at a constant pressure. The water tank 104 is coupled to a suction side or inlet of a constant volume pump 124 through a valve 120. The syrup tank 108 is also coupled through a measuring valve 121, a valve 122 and a mixing nozzle 123 to the suction side of the constant volume pump 124. The valves 120 and 122 are automatic control valves which open and close in synchronism with the start timing and the stop timing of the constant volume pump 124.

The measuring valve 121 is to adjust the flow rate of syrup. The mixing nozzle 123 is used to disperse syrup into liquid such as water.

A pressure gauge 125 is to measure an output pressure of the constant volume pump 124. A flow meter 126 can automatically control the rpm of the pump 124, if necessary, to control an amount of flowing mixed liquid constant, or can be used to adjust the rpm of the pump 124.

Numeral 127 denotes a check valve, numeral 128 denotes an automatic control valve for adjusting an amount of flowing liquid, and numeral 129 denotes an outlet of the mixed liquid. The check valve 127 is to prevent the mixed liquid from flowing reversely or leaking out when the pump 124 is stopped.

Oxygen contained in water supplied from the supply port 100 to the water tank 104 is sufficiently evacuated in the water tank 104 maintained to a predetermined vacuum by the vacuum unit 116 and the vacuum controller 130, and the liquid level of the water is maintained constant by the liquid level controller 109 and the liquid level control valve 101.

On the other hand, syrup supplied from the supply port 105 flows into the syrup tank 108 while being maintained at a constant level by the liquid level controller 110 and the liquid level control valve 106.

The evacuated water is sucked through the valve 120 by the constant volume pump 124.

The suction portion of the pump 124 is maintained at a constant pressure in a range of 0.1 to 0.2 [kg/cm$^2$.Abs] determined by the vacuum and the liquid level in the water tank 104.

Syrup in the tank 108 flows out through the valves 121 and 122 from the nozzle 123 into water while scattering sufficiently.

Since a pressure at the nozzle 123 is a sufficiently negative pressure as compared with that in the syrup tank 108, syrup from the tank 108 can flow out into water and the amount of syrup flowing out into water can be adjusted by the measuring valve 121. A pressure difference between points upstream and downstream of the valve 121 is substantially constant (strictly considering, it changes a little depending on an amount of flowing syrup) and is equal to a sum of a pressure difference between a pressure in the syrup tank 108 and a pressure near the mixing nozzle 123 and a liquid column pressure of syrup. The respective pressures and the liquid column pressure are maintained constant.

The constant volume pump 124 maintains constant the pressure at the suction side thereof and sends out the mixed liquid of the mixed water and syrup in a predetermined flow rate under pressure. The flow rate of the mixed liquid at the suction side of the constant volume pump 124 depends on the constant volume characteristic of the pump 124 and can be set by the rpm of the pump. Accordingly, the flow meter 126 and the control valve 128 are not necessarily required. Since the constant volume characteristic of the pump 124 is affected by a back pressure of the pump, when the back pressure changes, there are two methods for increasing accuracy of the flow rate of the mixed liquid as will now be described.

In a first method, the rpm of the pump 124 is adjusted by the flow rate measured by the flow meter 126 for any pressure measured by the pressure gauge 125 to make constant the flow rate of the mixed liquid. This method can be automatically controlled by common means.

In a second method, the flow rate of the mixed liquid is adjusted constant by utilizing the fact that the flow rate of the mixed liquid is propotional to the rpm of the pump 124 when the opening of the control valve 128 is adjusted to maintain constant the pressure measured by the pressure gauge 125.

When a flow rate of the mixed liquid output from the pump 125 is QM [1/min] and a flow rate of syrup flowing by adjusting the measuring valve 121 is QS [1/min], a flow rate QW [1/min] of the evacuated water to be processed is given by $$QW = QM - QS$$

When the pressure at the suction side of the pump 124 is maintained constant and the level of syrup in the tank 108 is maintained constant with the pressure therein being the stable atmospheric pressure or maintained at a constant holding pressure, the flow rate of syrup is determined by an opening of the measuring valve 121. Accordingly, by adjusting the revolution of the pump 124 to make constant the flow rate of the mixed liquid, the flow rate of the evacuated water is determined automatically, so that water and syrup can be mixed in a predetermined ratio.

According to the above embodiment, the following effects can be obtained:

(1) As compared with the prior art, an evacuation tank and a mixing tank are not required and the number of tanks is two which is half of that in the prior art;

(2) Since the evacuation tank is not necessary (using the water tank in the prior art), its associated water supply control equipment, pump for sending out the evacuated water witn pressure and pipes for supplying liquid are all unnecessary and the number of components is greatly reduced;

(3) Since the negative pressure for the vacuum evacuation in the water tank is utilized in order to draw out syrup from the syrup tank, an additional pressure on the syrup tank is not necessary and it can utilize the stable atmospheric pressure. Further, pressure may be applied if desired;

(4) It is not required to measure or adjust the flow rate of the evacuated water to be processed;

(5) Power consumption can be greatly reduced by using the constant volume pump. Table 1 shows comparison of power requirements of a motor in the prior art of FIG. 1 and power requirements of a motor in the present invention;

TABLE 1

Figure 1:
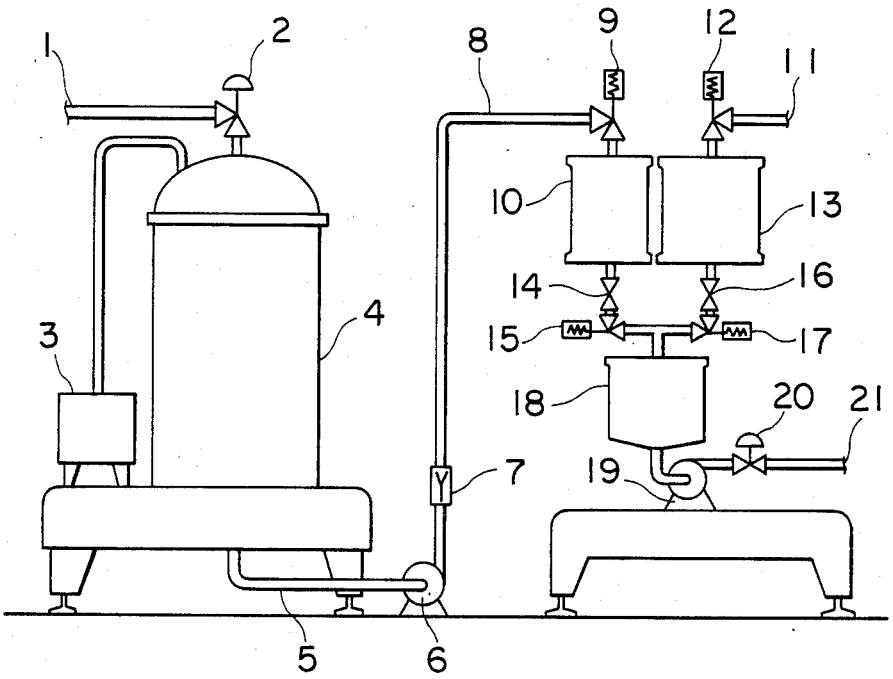
FIG. 1 PRIOR ART
FIG. 1 is a schematic diagram showing a prior art mixing apparatus.

| Comparison | Prior art system of FIG. 1 | | | Volume Control |
|---|---|---|---|---|
| Mixed Flow Rate | Pump for sending water | Pump for mixing | Total | Pump of Present System |
| 100 l/min | 3.7 kW | 7.5 kW | 11.2 kW | 3.7 kW |
| 200 l/min | 3.7 kW | 7.5 kW | 11.2 kW | 5.5 kW |
| 300 l/min | 5.5 kW | 11 kW | 16.5 kW | 7.5 kW |
| 500 l/min | 5.5 kW | 15 kW | 20.5 kW | 11.0 kW |

(6) The apparatus can be sterilized and washed readily and in a short time with less consumption of sterilizer and detergent since the number of tanks is reduced;

(7) The control apparatus and its operation are simple since objects to be controlled are less;

(8) Noise is greatly reduced by using the constant volume pump. For example, if centrifugal pumps 6 and 19 are used in the prior art of FIG. 1, noise is 80–90 dB(A), whereas it is about 70–75 dB(A) in the present invention;

(9) Since the flow rate of the mixed liquid depends on the constant volume characteristic of the constant volume pump and can be set by the rpm of the pump, the flow meter and the flow rate adjusting valve are not necessary. There is no leakage in a casing of the pump and when the back pressure of the pump changes, a setting flow rate changes. Therefore, when it is required to increase the setting accuracy of the flow rate without influence of variation of the back pressure, there can be used a method in which the flow rate is measured to control the rpm of the pump or a method in which an opening of the adjusting valve is adjusted so that the output pressure of the pump is always maintained constant.

We claim:

1. A liquid mixing apparatus comprising:

a first tank for storing first liquid;

a second tank for storing second liquid;

a vacuum unit operatively connected to said first tank for maintaining the inside of said first tank at a predetermined vacuum pressure;

a second pressure maintaining unit for maintaining a pressure in said second tank at a predetermined pressure;

a constant volume pump having an inlet;

mixing means connected to said inlet of said pump for mixing said first and second liquids and to which said first and second liquids in said first and second tanks are supplied; and a measuring unit for adjusting an amount of supply of said second liquid to said mixing means.

2. An apparatus as claimed in claim 1 wherein said vacuum unit comprises:

a vacuum pump operatively connected to said first tank for evacuating said first tank.

3. An apparatus as claimed in claim 1 and further comprising:

a measuring unit for adjusting an amount of supply of said first liquid to said mixing means.

4. A liquid mixing apparatus comprising:

a first tank;

a first liquid supply unit comprising a liquid level control means for supplying a predetermined amount of first liquid to said first tank;

a vacuum unit operatively connected to said first tank for maintaining the inside of said first tank at a predetermined vacuum pressure;

an outlet conduit from said first tank for said first liquid;

a constant volume pump having an inlet connected to said first tank outlet conduit;

a second tank;

a second liquid supply unit comprising a liquid level control means for supplying a predetermined amount of second liquid to said second tank;

an outlet conduit connected at one end to said second tank for said second liquid and operatively connected at the other end with said constant volume pump inlet;

a measuring means in said second tank outlet conduit; and a second liquid mixing unit in said second tank outlet conduit comprising a nozzle for mixing said first and second liquids.

5. A mixing apparatus as claimed in claim 4 wherein:

said nozzle is disposed in said first tank outlet conduit and has a nozzle inlet connected to the other end of said second tank outlet conduit.

6. A liquid mixing apparatus as claimed in claim 5 wherein said liquid level control means for said first and second liquids each comprises:

a liquid inlet pipe;

a liquid level control valve in said liquid inlet pipe; and a liquid level controller for detecting the liquid level in the respective tank and operatively connected to said control valve for operating said control valve.

7. A liquid mixing apparatus as claimed in claim 4 wherein said liquid level control means for said first and second liquids each comprises:

a liquid inlet pipe;

a liquid level control valve in said liquid inlet pipe; and a liquid level controller for detecting the liquid level in the respective tank and operatively connected to said control valve for operating said control valve.

* * * * *